United States Patent [19]

Adams

[11] Patent Number: 4,495,672

[45] Date of Patent: Jan. 29, 1985

[54] HINGE LATCH

[75] Inventor: Mark J. Adams, Bainbridge Island, Wash.

[73] Assignee: The Boeing Company, Seattle, Wash.

[21] Appl. No.: 491,954

[22] PCT Filed: Feb. 22, 1983

[86] PCT No.: PCT/US83/00244

§ 371 Date: Feb. 22, 1983

§ 102(e) Date: Feb. 22, 1983

[87] PCT Pub. No.: WO84/03325

PCT Pub. Date: Aug. 30, 1984

[51] Int. Cl.[3] ..... E05D 7/10; E05D 15/50

[52] U.S. Cl. ..... 16/229; 16/258; 16/380

[58] Field of Search ..... 16/230, 229, 232, 231, 16/257, 258, 380

[56] References Cited

U.S. PATENT DOCUMENTS

| | | | |
|---|---|---|---|
| 1,425,995 | 8/1922 | McGiveney . | |
| 1,972,575 | 9/1934 | Schmidt . | |
| 2,369,148 | 2/1945 | Langhorst | 16/229 |
| 4,178,657 | 12/1979 | Way, Jr. | 16/229 |

FOREIGN PATENT DOCUMENTS

| | | |
|---|---|---|
| 1708255 | 5/1971 | Fed. Rep. of Germany . |
| 2823397 | 12/1979 | Fed. Rep. of Germany . |
| 790268 | 11/1935 | France . |
| 264855 | 2/1950 | Switzerland . |

*Primary Examiner*—James M. Meister

*Attorney, Agent, or Firm*—Hughes, Barnard & Cassidy, P.S.

[57] ABSTRACT

A hinge latch (10) is comprised of a first hinge latch plate (20) having a pair of pintle recesses (34) separated by a hinge boss (36) including hinge bores (42) disposed toward the pintle recesses; a second hinge latch plate (22) having a pair of pintle guides (56) of complementary geometric configuration with respect to the pintle recesses, these pintle guides bounded by a pintle guide recess (60) for receiving the hinge boss when the pintle guides are disposed within the pintle recesses; a first (66) and a second (68) pintle member, each comprised of a hinge pin member (70) received within a respective one of the pintle guides in a slot (58) formed therein and having a free distal end for projection within a respective one of the hinge bores for pivotal hinging movement of the first and second latch plates about a transverse axis, and a hinge pin plate (72) secured to the hinge pin having a lateral leg (74) terminating at its distal end in a diagonally disposed abutment edge (76); a biasing member (86) for urging each of the pintle members into a normal hinging configuration; and, a latch actuator member (94) received interiorly of the second hinge latch plate having an actuator stem (96) and a generally trapezoidal head (98) including opposed, diagonally disposed abutment edges (112) for mating engagement with the abutment edges of the first and second pintle members.

11 Claims, 6 Drawing Figures

FIG. 1
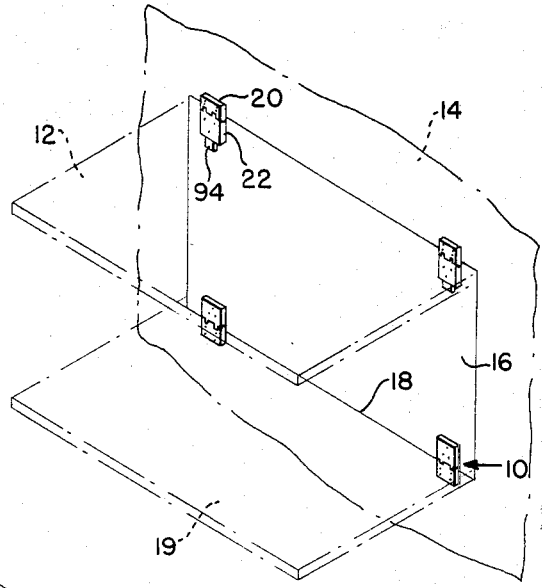
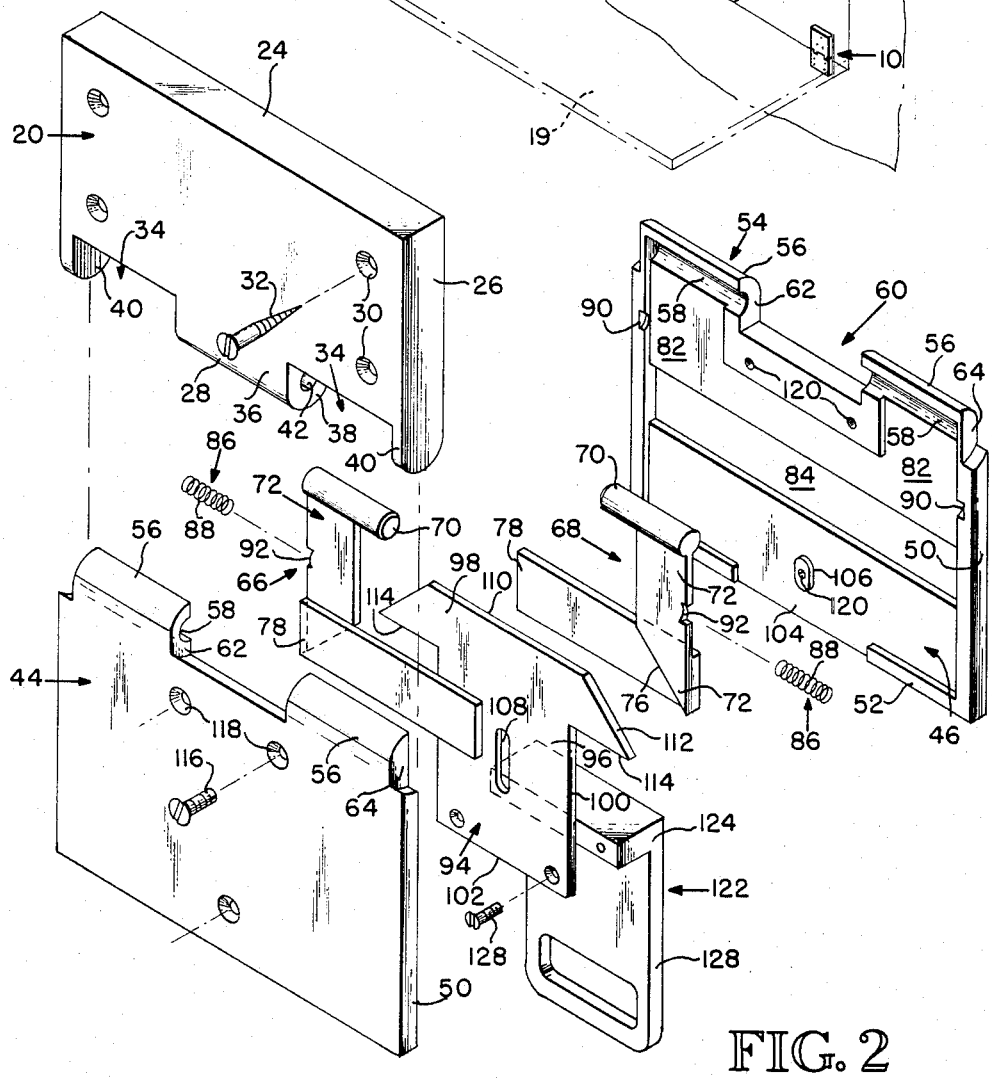
FIG. 2

HINGE LATCH

DESCRIPTION

1. Technical Field

The present invention relates generally to a hinge latch configured for selectively releasable, pivotable hinging securement of relatively moveable structural members and, more especially, to an improved device of that character particularly adapted to function as a hinge joining those structural members for pivotal movement thereof and, in a correlary mode, as a latch allowing releasable displacement of the hinge components for separation of those structural members.

2. Description of the Background Art

There are several environments within which it is desirable to secure a pair of structural members in such a fashion that the same may be pivotally disposed about a hinge member or array of same and which may also be separated relative to one another for some good advantage. For example, motor vehicles have sometimes been provided with cargo doors particularly constructed for hinged disposition relative to the body of the vehicle about either a horizontal or vertical hinge line. Likewise, household appliances, most notably refrigerators, have sometimes been equipped with devices allowing the door to be pivoted from either the right-hand or left-hand side thereof upon the desires of the user. The devices utilized to achieve these desired results, commonly dubbed "hinge latches", all have certain basic attributes in common. In capsule summary, the hinge pintle providing a stationary point of securement for pivotal motion of one member relative to the other is itself displaceable in order that male and female parts associated respectively with the two members may be separated in the nature of a latch.

The devices heretofore proposed, certain of which are discussed in greater detail below, have historically suffered two important drawbacks as particularly respects the most preferred enviroment for the device of the present invention—use in an aircraft. On the one hand, conventional hinge latch structures have tended to be exceedingly complex mechanisms, oftentimes mandating a specific design of the structural members pivotally secured thereby in order to accept the device. Hence, with the hinge latch and, e.g., door structure collectively defined in terms of design, most approaches do not admit of the ability to retrofit existing structures to achieve the benefits of releasable, pivotal securement thereof. On the other hand, and generally related to the foregoing, these complicated designs impose a severe weight penalty within the context of aircraft usage.

Turning to the patented prior art devices, that described in U.S. Pat. No. 2,261,146 typifies one conventional approach in the design of these hinge latches. The apparatus is one destined for the releasable securement of a refrigerator door or the like wherein the hinge latch itself forms an integral part of the door construction. It is a hinge latch best described as one comprised of a pair of so-called hinge butts secured to the refrigerator proximate each side of the door, in turn including upper and lower hinge lugs. An articulated hinge linkage is associated with the door at each of the butt locations with retractable hinge pin elements cooperating within the lugs to establish a hinging relationship. Opposed pairs of hinge latch devices are associated with a latch for the door through additional linkage members, the articulated hinge pins being responsive to the associated latch.

Manipulation of the latch is translated to the articulated linkage through pivot points folding that linkage out of engagement with the respective lugs. With the pins disposed within the lugs, those hinge latches on the opposed side of the door function as a hinge, thereby allowing the door to open from either side at the desire of the user. The construction of that device includes a fairly ungainly linkage interaction and, furthermore, mandates a specific door design to accommodate the hinge latch; limiting the range of adaptability of that design.

U.S. Pat. No. 3,663,989 discloses another latch and hinge device having a master latch and at least one slave latch positioned along a common line. The slave latches are coupled to the master and also to each other by a common actuator bar, the movement of which selectively engages or disengages the latch components thereby locking or unlocking the associated structural members. Each of the latches includes a first base member connected to a first wall member and a second base connected to a second wall member. The base members have at least one projection with a bore formed therein, adapted to be aligned axially upon engagement of the base members. A latch engaging member comprised of an elongate bar is slidably mounted on the first wall member between it and projections on the first base member. This elongate bar has at least two spaced rod members fixed to blocks attached to the bar in substantially adjacent relationship with respect to the latches, which rods are receivable within the axially aligned bores. The device further includes means for actuating the engaging member, including an elongate cylindrical member having both a smooth and a threaded portion. The smooth portion is rotatably positioned within an aperture formed in the projection on the first base member of the master latch, while the threaded portion is received in a cooperative threaded bore formed in the block member adjacent the master latch. Rotation of the elongate cylindrical member effects sliding of the bar relative to the projection in order to insert the rods into the aligned bores and operate the device. As is evident from the foregoing description, the hinge latch is a fairly complicated one structurally, mandates an integral door design to permit its useful implementation, and the pulling motion required can be an awkward one for the user to manipulate the device for its latching function.

U.S. Pat. No. 3,406,483 suggests yet a different approach, in this instance in the context of a hinge latch for the cargo door of a motor vehicle. Apart from an overall similarity in respect of the functional objectives of that device vis-a-vis the instant invention, the appoach there resides in a ball and socket design and therefore is applicable only in the broadest sense of background.

Among other background references of this general ilk may be mentioned U.S. Pat. Nos. 4,132,034, 3,976,024, 3,861,083, 3,403,473, 3,048,898, 2,822,630, and 2,166,534. Those patents describe various other hinge latch structures, but offer little further practical insight into the scope of pertinent background; insofar as most of these additional structures mandate a total hinge latch/door design precluding the ability to retrofit, are relatively complicated mechanisms, and in turn become relatively expensive to fabricate and/or incorporate within a given application.

Consequently, it is apparent that the need exists to provide an improved hinge latch structure which preserves the distinct advantage of a device configured for selectively releasable, pivotable hinging securement of one structural member movable relative to another cooperative structural member; but one which enjoys a simpler overall design without sacrificing efficiency and/or reliability in use. A further significant need is for a device providing such advantages which is further adaptable for use within an aircraft environment, wherein the added objective of lightweight can be of paramount concern in discriminating acceptable devices notwithstanding advantages important in other applications.

SUMMARY OF THE INVENTION

The present invention responds to the foregoing needs. A lightweight, structurally sound and reliable hinge latch is provided in accordance with the present invention. The instant hinge latch is particularly desirable for the ease with which it may be implemented without the need to resort to elaborate door modifications or the like, and therefore enjoys a distinct advantage in retrofitting applications. The specific design is one found to be particularly desirable from many points of view; including, inter alia, relatively few moving parts giving rise to an ease and economy of fabrication along with reliability in use, and a design minimizing the throw or travel of the actuating mechanism requiring application of a relatively low unlatching force thereby facilitating its end use as well.

The foregoing, and other advantages of the present invention, are realized in one aspect thereof by a hinge latch configured for selectively releasable, pivotable hinging securement of one structural member moveable relative to another cooperative structural member, comprising a first hinge latch plate in operative association with the first structural member, having a pair of transverse pintle recesses separated one from another and bounded intermediately by a hinge boss including hinge bores disposed transversely toward a respective one of the pintle recesses; a second hinge latch plate in operative association with the second structural member, having a pair of transverse pintle guides of complimentary geometric configuration with respect to the pintle recesses for mating engagement therein, the pintle guides being separated one from another and bounded intermediately by a pintle guide recess likewise configured to receive the hinge boss when the pintle guides are disposed within the pintle recesses; first and second pintle members disposed for transverse reciprocable motion interiorly of the second hinge latch plate, each comprised of a hinge pin member received within a respective one of the pintle guides and having a free distal end for projection within a respective one of the hinge bores for pivotal hinging movement of the first and second latch plates about the transverse axis therethrough, the pintle members further including a hinge pin plate secured to the hinge pin disposed in guiding receipt within a cooperative plate slot interiorly of the second hinge latch plate and having a lateral leg terminating at its distal end in a diagonally disposed abutment edge; a biasing member urging each of the pintle means into a normal, hinging configuration of the device with the hinge pins disposed within the hinge bores; and a latch actuator member received internally of the second hinge latch plate for lateral movement therein, having an actuator stem and a generally trapazoidal head including opposed, diagonally disposed abutment edges for mating engagement with the abutment edges of the pintle members. An unlatching force applied to the latch actuator causes engagement between its abutment edges and those of the pintle members, in turn translated to a transverse force due to the diagonal disposition of these edges resulting in sliding displacement thereof. That transverse force thence effectuates transverse retraction of the hinge pins upon reciprocation of same within the pintle guides out of engagement with the hinge bores. That releases the first and second hinge latch plates allowing separation of the two structural members.

The only moving parts necessary for implementation of the instant hinge latch are the actuator member and the pair of pintle members, the latter operating against a biasing force. Those moving parts are guided within the second hinge latch plate by means of guide slots formed therein for that purpose; thus improving the reliability of the device through positive, guided coaction of these elements.

In a most preferred form of the present invention, the second hinge latch plate is a latch body comprised of a pair of shell members of identical configuration disposed and secured to each other in face-to-face relationship to yield an internal cavity receiving the moving parts of the device. Likewise, the first and second pintle members are designed as identical elements disposed again in face-to-face relationship but within the cavity of the latch body. Consequently, by the maximized use of identical parts in this manner, both the capital expenditures for fabrication of the latch components and assembly of same are materially reduced.

Other advantages of the present invention will become apparent, and a fuller appreciation of its construction and mode of operation will be gained upon an examination of the detailed description of preferred embodiments, taken in conjunction with the figures of drawing.

DESCRIPTION OF THE DRAWINGS

FIG. 1 is an isometric view showing a cupboard or like door mounted to a wall with four hinge latch structures in accordance with the present invention in order that the same can be opened from either the top or bottom, thus illustrating the present invention in one intended environment;

FIG. 2 is an exploded isometric view showing the elements comprising a highly preferred embodiment of a hinge latch in accordance with the present invention;

DETAILED DECRIPTION OF THE PREFERRED EMBODIMENTS

Figure 3:
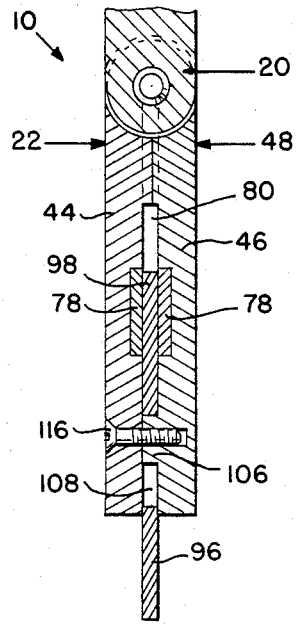
FIG. 3 is a sectional view of a hinge latch in accordance with the present invention.

The present invention relates, generally, to a hinge latch configured for selectively releasable, pivotable hinging securement of relatively movable structural members and, more especially, to an improved device of that character particularly adapted to function in one mode as a hinge joining those structural members for pivotal movement thereof and in a correlary mode as a latch allowing releasable displacement of the hinge for separation of the structural members. Accordingly, the present invention will now be described with reference to certain preferred embodiments within the aforementioned context; albeit, those skilled in the art will appreciate that such a description is meant to be exemplary and should not be deemed limitative.

Turning to the figures of drawing, in each of which like parts are identified with like reference characters, FIG. 1 illustrates a representative environment for a hinge latch in accordance with the present invention; four of which, designated generally as 10, are shown securing a cupboard door 12 to a supporting wall structure 14. The door 12 is a generally rectilinear door disposed within a complementary opening 16 within the wall 14. In many instances, such as in a galley of an aircraft, it is desirable for the door 12 to serve as a shelf or like member when the cupboard is opened and, accordingly, a cupboard door such as 12 has typically been hinged for pivotal motion along its lower edge 18. However, that objective is sometimes antagonistic to the ability of a flight attendant to gain easy access to the interior of the cupboard through opening 16, insofar as the upper edge 19 of that door projects outwardly and thereby restricts the length of effective reach within the cupboard. Use of the hinge latches 10 integrates completely these two objectives, allowing the door to be opened and pivoted downwardly about edge 18 to achieve a working surface yet allowing the door to be opened and pivoted upwardly about edge 19 in order to gain access. Furthermore, ease of cleaning is greatly facilitated since, as will be appreciated more fully from the ensuing description, the door 12 may be removed altogether for that purpose.

Figure 4:
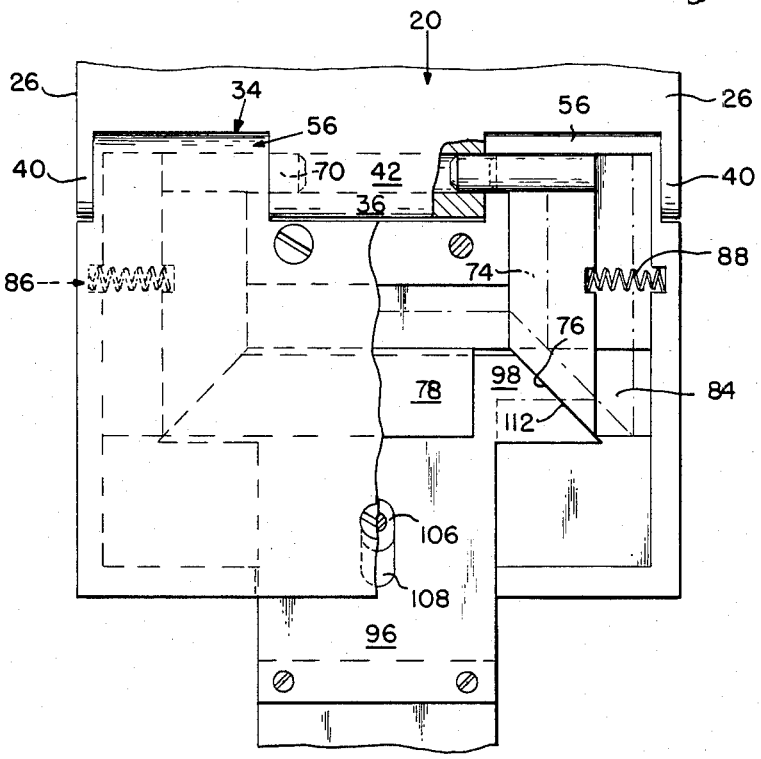
FIG. 4 is a side elevation view, with parts broken away for clarity, of a hinge latch in accordance with the present invention.

FIGS. 2–4 show in detail the components constituting the most preferred form of the hinge latch 10. Overall, there are two basic elements involved; a first hinge latch plate 20 and a cooperative, second hinge latch plate 22. The first plate 20 is in the nature of a female plate which, in this preferred embodiment, is a substantially solid member having an upper edge 24, opposed side edges 26 and a bottom edge 28. The female plate 20 is secured to or otherwise provided in operative association with one of the structural members to be hingedly joined (e.g., wall 14). For example, as shown in the figures, the plate is provided with a plurality of apertures 30 for receiving fixtures members 32 such as a screw or the like. Irrespective of that feature, the female plate 20 is formed with a pair of transverse pintle recesses identified generally as 34 located, in this instance, along the bottom edge 28 thereof. [Since the hinge latch 10 may be oriented in any one of a number of ways respecting the cooperative structural members, the term "transverse" will be used herein to define a reference line parallel to top face 24 and the term "lateral" will be employed to define a reference line perpendicular thereto and parallel to the side faces 26.] The two pintle recesses 34 are separated one from another and bounded intermediately by a hinge boss 36. The boss 36 presents opposed side faces 38 defining an inner edge of each recess 34; while a skirt portion of the side edges 26, identified as 40, define the opposing sides of these recesses. The hinge boss 36 includes hinge bores 42 disposed transversely toward each of the pintle recesses 34; in the preferred embodiment illustrated, these hinge bores actually being a continuous bore through the boss 36, although opposed blind holes of suitable depth would suffice equally well.

The second hinge latch plate 22 is formed in the nature of a male part; destined to be secured to the second structural member (e.g., door 12) or otherwise disposed in operative association therewith for ultimate cooperation with the plate 20. As best viewed with reference to FIGS. 2 and 3, the male plate 22 is formed from a pair of opposed shell members 44 and 46 secured in face-to-face relationship to define a latch body 48. In this preferred embodiment, each of the shells is an identical part, thus providing complete symmetry for the latch body 48 when the two are associated. Each shell is itself defined by opposed side edges 50, a bottom edge 52, and a top edge designated generally as 54. The top edge 54, when the shells are mated, is configured to provide a pair of transverse pintle guides 56, here shown to have a generally circular cross section including an internal slide or slot 58. The pintle guides 56 are dimensioned and configured to be of complementary relationship respecting the dimensions and configuration of the pintle recesses 34 in the plate 20. Accordingly, the guides 56 are separated one from another and bounded intermediately by a pintle guide recess designated generally as 60 formed along the top edge 54 and itself having a dimension and configuration complementary to that of the hinge boss 36 in order that the latter may nest within the former when the device 10 is in its latched, hinging configuration described more fully hereinbelow. Hence, at the juncture of the pintle guides 56 and the guide recess 60, a face 62 is defined and, at the extreme transverse edges of the guides 56 an opposed face 64 is yielded from a notch provided there for receipt of the skirt 40 at either end of the plate 20.

First and second pintle means 66 and 68 are disposed interiorly of the latch body 48 (intermediate the shells 44 and 46) for transverse reciprocable motion therein. Again, for simplicity sake and ultimate efficiency in use, each of the pintle means 66 and 68 is an identical part. In the embodiment of, e.g., FIG. 2, each of the pintle means includes a hinge pin 70, here in the form of a cylindrical member dimensioned for nesting receipt within a respective one of the slots 58. The distal ends of each pin is also dimensioned for projection within a respective one of the hinge bores 42 to yield a transverse hinge line therethrough when the device 10 is in the latched hinging configuration. Each of the pintle means is also formed to include a hinge pin plate designated generally as 72 secured to the bottom circumferential periphery of the hinge pin 70. In the embodiment of FIGS. 2–4, the hinge pin plate is comprised of a lateral leg 74 having its proximal end joined to the hinge pin 70 extending from about the proximal end thereof to a position intermediate its length, thus yielding a pin projection extending transversely beyond that leg 74. The distal end of the lateral leg 74 terminates in a diagonally disposed edge 76 defining an abutment surface. This embodiment further includes a transverse leg 78 joined in overlapping relationship at the terminus of the lateral leg 74. Thus, when the two pintle means are disposed within the latch body 48 in face-to-face contact as shown in FIGS. 2 and 3, a slide channel or slot 80 is provided due to the double thickness at the extreme transverse edges where the lateral and transverse legs join.

The hinge pin plates 72 serve not only to support the hinge pins 70 and present them properly for reciprocable disposition within the guides 56, but to stabilize the same in use and during any unlatching motion for the device. Accordingly, each shell 54 and 56 is preferably formed with an inner, lateral recess or contour 82 for guiding receipt of the lateral leg 74 and, where the transverse leg 78 is included, a like transverse recess 84 in order that the composite of those shells (to yield the latch body 48) will provide internal guide slots for the pintle means.

Biasing means, designated generally as 86, are provided to effect an inwardly directed transverse force urging the distal end of each hinge pin 70 within the respective hinge bore 42 in order that the device 10 will assume a normal hinging configuration. In the embodiment shown in FIGS. 2–4, these biasing means 86 are comprised of a coil spring 88 disposed within a channel formed by slots 90 in the side edges 50 of each of the shell members and a corresponding slot 92 in the edges of the lateral legs 74. Optionally, but preferably, the slot or recess 92 has a slightly outwardly directed radiused contour or similar slight projection for disposition interiorly of the spring 88 in order to maintain the same in good registration. In any event, the biasing means 86 serve to force each of the pintle means 66 and 68 transversely inward up to the point permitted either by the cooperative dimensioning of pin 70 and recess 42 or the width of leg 74 relative to that of the lateral recess 82.

A latch actuator, designated generally as 94, is also disposed interiorly of the latch body 48, received in sliding engagement therein within the channel 80. The latch actuator is comprised of a stem 96, here shown to be a generally rectilinear member, terminating in a trapazoidal head 98. The stem 96 is defined between opposing side edges 100 and includes a bottom edge 102. The bottom edge 52 of each of the shells 44 and 46 is interrupted to yield a recess 104 having a transverse or width dimension only slightly greater than that of the stem 96 as defined between the side edges 100, allowing the bottom edge 102 to project downwardly through the bottom edge of the latch body 48, as best viewed in FIGS. 3 and 4. Each of the shells is further formed with a post projection 106 destined for mating engagement across the thickness of the plate 22 for disposition through a guide slot 108 within the stem 96. Accordingly, a three-point guide is established for lateral reciprocable motion of the latch actuator 94, constituted of the edge abutments of recess 104 and projection of posts 106 through the guide slot 108. The transverse or width dimension of the slot 108 is preferably only slightly greater than the same dimension of the post projections 106, while the lateral dimension of the slot relative to the posts define the limit of travel of the latch actuator. The trapazoidal head 98 includes a top edge 110, opposed, diagonally disposed edges 112 providing an abutment surface for cooperation with the diagonal edges 76 on the pintle means, and bottom edges 114. The angle of the diagonal edges on both the actuator and pintle means is the same, about 45° being most preferred.

The overall components of the hinge latch plate 22, namely the shells 44 and 46 confining the pintle means 64 and 66 along with captured actuator 94, are secured into an assembly by means of fixture members 116 disposed through fixture holes 118, here shown in shell 44, into tapped holes 120 in the shell 46. With the plate 22 assembled, as shown in FIGS. 3 and 4, the biasing members 86 maintain the pintle means in registration within the pintle boss to yield the transverse hinge line, while the latch actuator rests upon the post 106 disposed beneath the hinge pin plates 72, with its bottom edge projecting outwardly of the plate 22. The abutment surfaces provided by the diagonal edge 76 of each hinge pin plate and the diagonal edge 112 at opposing end of the trapazoidal head 98 on actuator 94 are designed to translate an upward (lateral) unlatching force on the stem 96 into an outwardly directed (transverse) force separating the hinge pins from the hinge boss. More specifically, and as best envisioned with respect to the phantom representations of FIG. 4, the upward force on the latch actuator urges the trapazoidal head upwardly within the channel 80. The three-point disposition of the stem as aforesaid confines its motion to a lateral one but, because of the angled relationship of the abutment faces, that motion causes a sliding disposition of the lateral leg 74 thus converting the lateral force into a transverse one operating against the biasing force of spring 88. Continued upward displacement of the latch actuator causes continued peripheral displacement of the hinge pin plate within the guide slots until, as shown in FIG. 4, complete retraction of the distal end of each pin 70 from the hinge bores 42 is achieved. At that point the two plates 20 and 22 may be separated —that is, unlatched.

Before continuing with a description of various optional elements and/or designs for the hinge latch in accordance with the present invention, it is noteworthy to consider the elegant simplicity of the basic components described above. The female plate 20 is of very simple structure and configuration, preferably a single piece very easily formed by conventional techniques. While the cooperative plate 22 includes a greater number of elements, the basic components maximize the use of identical elements associated in mirror image (i.e., both of the individual shells 44 and 46 are identical members as are the two pintle means 66 and 68) thereby reducing the cost of fabrication without the sacrifice of efficiency or reliability. Hence, whether these elements be fabricated by forging, casting, or molding techniques (dictated by the desires of the fabricator and the specific materials employed) the required capital expenditure is substantially reduced. The last major structural component is the actuator, which is again of very simple overall design admitting of ease of manufacture be any of the aforementioned techniques. Accordingly, if casting is the approach of choice, a single mold is required for the hinge latch plate 20 while but three are demanded to provide the overall components for the hinge latch plate 22 (other than the fungible elements such as screws, springs and the like.

Figure 5:
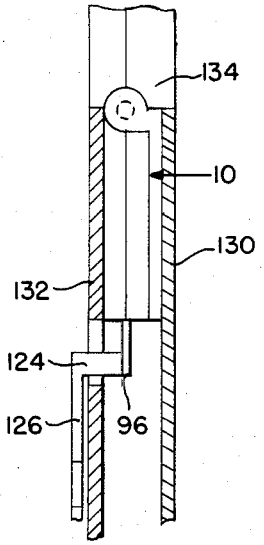
FIG. 5 is a sectional view showing a hinge latch in accordance with the present invention, specifically adapted for remote actuation from a position otherwise obstructed, precluding free manipulation of the hinge latch; and, FIG. 6 is an exploded isometric, partially diagrammatic view of the elements comprising an alternate embodiment in accordance with the present invention, with certain parts omitted for the sake of clarity.

Returning to a description of the elements constituting the hinge latch 10, it sometimes occurs that the specific application at hand either requires a blind hinge location which would otherwise obstruct the actuator or is greatly facilitated by allowing for remote actuation of the latch function of the device. Accordingly, viewing FIGS. 2, 4 and 5 collectively, a remote actuator, designated generally as 122, may be included to provide that advantage. This remote actuator is shown to be of generally "L"-shaped configuration including a spacer 124 as a first leg and an actuator extension 126 as the second leg. Most preferably, the two are separate components, allowing spacers of various dimensions to be selected depending upon the thickness of the structural member obstructing the hinge latch from direct actuation via the stem 96; albeit, a unitary approach may be adopted. In either event, the remote actuator 122 is simply secured to the stem 96 proximate its bottom edge 102 by means of fixture members 128. Considering this optional remote actuator in one potential enviroment, FIG. 5 shows the hinge latch 10 in a blind location where a pair of structural members 130 and 132 are to be releasably jointed for hinging motion about, e.g., a jam 134. In this instance, a gap 136 between the panels is too narrow to permit direct actuation of the latch and, accordingly, the spacer 124 is provided, having a length sufficient to present the extension 126 at a more convenient location. Otherwise, the latch functions exactly the same as described above, with an upward force as viewed in FIG. 5 ultimately providing the necessary unlatching force transmitted through latch actuator 94 to the pintle means.

Figure 6:
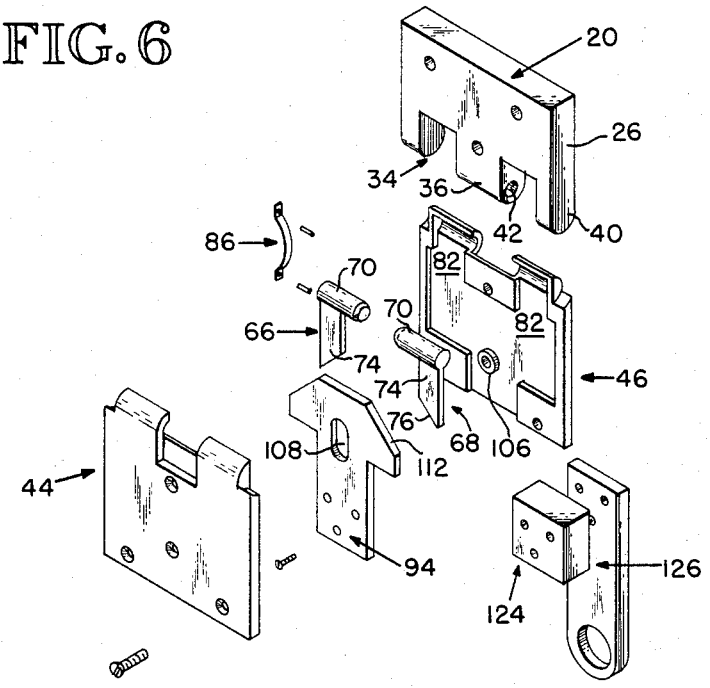

FIG. 6 illustrates, in a generally diagrammatic sense, an alternate embodiment of a hinge latch. Because this embodiment differs only very little from that viewed in FIG. 2, identical parts are identified with identical reference numerals in order to provide a brief description. In this instance, the principal difference resides in the pintle means 66 and 68, in the sense that the same include but the lateral leg 74, omitting the transverse leg 78. The inclusion of that leg is made with an eye toward added rigidity of the components, providing better structural integrity both during normal hinging and during the unlatching transition. However, in many instances the force to be encountered by the hinge latch is sufficiently low that this element may be excluded without sacrificing reliability. The biasing means 86 are also of somewhat different form in the embodiment of FIG. 6; here that element shown to be a leaf spring as opposed to a coil spring (only one of which is shown for clarity) and pin registers for locating the leaf spring along the inner margin of side edges 50. The function obviously remains the same—biasing the pintle means into the hinging configuration. Again, where relatively low force loads are anticipated, this approach may be deemed advantageous.

While the invention has now been described with reference to certain preferred embodiments and exemplified in terms of advantages to be realized in various enviroments, those skilled in the art will appreciate that various modifications, changes, omissions and substitutions may be made without departing from the spirit thereof. Accordingly, it is intended that this description be deemed exemplary of representative structure in accordance with the present invention, and not work a limitation on the scope of the claims granted herein.

I claim:

1. A hinge latch configured for selectively releasable, pivotable hinging securement of one structural member moveable relative to another cooperative structural member, comprising:

(a) a first hinge latch plate in operative association with a first structural member, having a pair of transverse pintle recesses separated one from another and bounded intermediately by a hinge boss including hinge bores disposed transversely toward said pintle recesses;

(b) a second hinge latch plate in operative association with a second structural member moveable relative to said first member, having a pair of transverse pintle guides of complementary geometric configuration with respect to said pintle recesses for mating engagement therein, said pintle guides separated one from another and bounded intermediately by a pintle guide recess for receiving said hinge boss when said pintle guides are disposed within said pintle recesses;

(c) first and second pintle means disposed for transverse reciprocable motion interiorly of said second hinge latch plate, each comprised of a hinge pin member received within a respective one of said pintle guides and having a free distal end for projection within a respective one of said hinge bores for pivotal hinging movement of said first and second latch plates about a transverse axis and a hinge pin plate secured to said hinge pin member disposed in guiding receipt within a cooperative plate slot interiorly of said second hinge latch plate and having a lateral leg terminating at its distal end in a diagonally disposed abutment edge;

(d) biasing means for urging each of said pintle means into a normal hinging configuration with said hinge pins disposed within said hinge bores; and, (e) latch actuator means received interiorly of said second hinge latch plate for lateral movement therein, having an actuator stem and a generally trapezoidal head including opposed, diagonally disposed abutment edges for mating engagement with the abutment edges of said first and second pintle means;

wherein lateral displacement of said actuator stem with an unlatching force is translated across said abutment edges to a transverse force displacing said hinge pins transversely out of engagement with said hinge bores releasing said hinge latch plates.

2. The hinge latch of claim 1, wherein said hinge pin plate further includes a transverse leg joined in partially overlapping relationship proximate the distal end of said lateral leg.

3. The hinge latch of claim 2, wherein said first and second pintle means are disposed in generally face-to-face relationship within said second hinge latch plate with said transverse legs separated by said lateral legs to yield a lateral channel therebetween for guiding receipt of said latch actuator means.

4. The hinge latch of claim 3, wherein said pintle recesses are generally cylindrical recesses and said pintle guides are generally cylindrical guides for mating engagement therein.

5. The hinge latch of claim 4, wherein said second hinge latch plate is comprised of a pair of shell members disposed in face-to-face relationship and having formed therein guide slots for said lateral and transverse legs of said hinge pin plates.

6. The hinge latch of claim 5, wherein said stem of said latch actuator means includes a central guide slot and said shell members each include a post projection for guiding disposition within said central guide slot.

7. The hinge latch of claim 6, wherein said biasing means is comprised of a pair of springs within said second hinge latch plate, one of each disposed in biasing contact with a corresponding one of said lateral legs.

8. The hinge latch of claim 7, wherein said shell members are identical and said pintle means are identical.

9. The hinge latch of claim 8, further comprising generally "L"-shaped remote actuator means secured to said stem.

10. A hinge latch configured for selectively releasable, pivotable hinging securement of one structural member movable relative to another cooperative structural member, comprising:

(a) a female hinge latch plate secured to a first structural member, having first and second transverse pintle recesses separated one from another and bounded intermediately by a hinge boss including a hinge bore extending therethrough;

(b) a male latch plate in operative association with a second structural member movable relative to said first member, comprised of a pair of identical plate shell members disposed in face-to-face relationship and defining a cavity therein, said male hinge latch plate including first and second transverse pintle guides having a generally cylindrical onfiguration for mating engagement within a respective one of said pintle recesses, said pintle guides separated one from another and bounded intermediately by a pintle guide recess for receiving said hinge boss when said pintle guides are disposed within said pintle recesses, and further wherein said pintle guides include an internal channel for registration with said hinge bore;

(c) first and second pintle means disposed for transverse reciprocable motion interiorly of male hinge latch plate within said cavity, each comprised of a hinge pin for sliding receipt within said internal channels and for projection within a respective one of said hinge bores for pivotal hinging movement of said male and female latch plates about a transverse axis, a lateral leg depending downwardly from said hinge pin extending from the proximal end to a location intermediate the length thereof and terminating at its distal end in a diagonally disposed abutment edge, and a transverse leg secured proximate the distal end of said lateral leg in overlapping engagement therewith;

(d) biasing means, including spring means in biasing contact with each of said lateral legs, for urging each of said pintle means into a normal hinging configuration with said hinge pins disposed within said hinge bores; and, (e) latch actuator means received interiorly of said male hinge latch plate, including a stem disposed intermediate said transverse legs within a channel formed thereby, and a generally trapezoidal head including opposed, diagonally disposed abutment edges for mating engagement with the abutment edges of said first and second pintle means, wherein the angle of said abutment edges is about 45°;

wherein lateral displacement of said actuator stem with an unlatching force is translated across said abutment edges to a transverse force displacing said hinge pins transversely out of engagement with said hinge bores releasing said hinge latch plates.

11. The hinge latch of claim 10, further comprising generally "L"-shaped remote actuator means secured to said stem.

* * * * *